US008115684B2

(12) United States Patent
Palin

(10) Patent No.: US 8,115,684 B2
(45) Date of Patent: Feb. 14, 2012

(54) METHOD OF PRODUCTION OF AN ANTENNA PATTERN

(75) Inventor: Ulf Palin, Ljusterö (SE)

(73) Assignee: First Technologies, LLC, Chesterfield, MO (US)

( * ) Notice: Subject to any disclaimer, the term of this patent is extended or adjusted under 35 U.S.C. 154(b) by 478 days.

(21) Appl. No.: 12/443,615

(22) PCT Filed: Oct. 12, 2007

(86) PCT No.: PCT/SE2007/000898

§ 371 (c)(1),
(2), (4) Date: Mar. 30, 2009

(87) PCT Pub. No.: WO2008/048162

PCT Pub. Date: Apr. 24, 2008

(65) Prior Publication Data

US 2010/0026583 A1 Feb. 4, 2010

(30) Foreign Application Priority Data

Oct. 17, 2006 (EP) ..... 06021750

(51) Int. Cl.
*H01Q 1/38* (2006.01)

(52) U.S. Cl. ..... 343/700 MS; 343/702; 343/767; 343/770

(58) Field of Classification Search ..... 343/700 MS, 343/702, 767, 770; 29/600, 601
See application file for complete search history.

(56) References Cited

U.S. PATENT DOCUMENTS

| | | | | |
|---|---|---|---|---|
| 4,197,545 | A * | 4/1980 | Favaloro et al. | 343/700 MS |
| 5,025,264 | A * | 6/1991 | Stafford | 343/767 |
| 5,321,411 | A * | 6/1994 | Tsukamoto et al. | 343/700 MS |
| 6,177,909 | B1 * | 1/2001 | Reid et al. | 343/700 MS |
| 6,208,293 | B1 * | 3/2001 | Adams et al. | 342/368 |
| 6,486,837 | B2 * | 11/2002 | Spiegel et al. | 343/702 |
| 6,977,613 | B2 * | 12/2005 | He et al. | 343/700 MS |
| 7,480,979 | B2 * | 1/2009 | Moren | 29/600 |
| 2001/0050638 | A1 | 12/2001 | Ishitobi et al. | |
| 2002/0149521 | A1 | 10/2002 | Hendler et al. | |
| 2003/0108664 | A1 | 6/2003 | Kodas et al. | |
| 2004/0060162 | A1 | 4/2004 | Moren | |
| 2005/0070376 | A1 * | 3/2005 | Savarese et al. | 473/353 |
| 2005/0200539 | A1 | 9/2005 | Forster et al. | |
| 2005/0237243 | A1 | 10/2005 | Annamaa et al. | |

FOREIGN PATENT DOCUMENTS

| | | | |
|---|---|---|---|
| EP | 1 022 803 | A2 | 7/2000 |
| EP | 0 911 906 | A2 | 4/2009 |
| GB | 2 280 068 | A | 3/2003 |
| WO | WO 99/53568 | | 10/1999 |
| WO | WO 01/24314 | A1 | 4/2001 |

* cited by examiner

*Primary Examiner* — Hoang V Nguyen
(74) *Attorney, Agent, or Firm* — Harness, Dickey & Pierce, P.L.C.

(57) ABSTRACT

The present invention relates to a method of production of an antenna pattern having a predetermined general outline, with an ink jet printer, laser activation device or similar device. The device creates the antenna pattern with a plurality of empty inner portions within the general outline.

20 Claims, 4 Drawing Sheets

| filled | |
|---|---|
| 1381.3 | -6.0 dB |
| 1558.4 | -6.0 dB |
| Bandwidth | @ -6.0 dB |
| No. 1 | 177.1 MHz |

| grid1 | |
|---|---|
| 1376.6 | -6.0 dB |
| 1552.8 | -6.0 dB |
| Bandwidth | @ -6.0 dB |
| No. 1 | 176.2 MHz |

| grid2 | |
|---|---|
| 1350.4 | -6.0 dB |
| 1524.6 | -6.0 dB |
| Bandwidth | @ -6.0 dB |
| No. 1 | 174.2 MHz |

| grid4 | |
|---|---|
| 1340.8 | -6.0 dB |
| 1506.9 | -6.0 dB |
| Bandwidth | @ -6.0 dB |
| No. 1 | 166.1 MHz |

| toteff-fill | |
|---|---|
| 1369.4 | -3.0 dB |
| 1587.3 | -3.0 dB |
| Bandwidth @-3.0 dB | |
| No.1 | 217.9 MHz |

| toteff-grid1 | |
|---|---|
| 1362.2 | -3.0 dB |
| 1582.2 | -3.0 dB |
| Bandwidth @-3.0 dB | |
| No. 1 | 220.0 MHz |

| toteff-grid2 | |
|---|---|
| 1340.4 | -3.0 dB |
| 1549.0 | -3.0 dB |
| Bandwidth @-3.0 dB | |
| No. 1 | 208.6 MHz |

| toteff-grid4 | |
|---|---|
| 1330.1 | -3.0 dB |
| 1516.1 | -3.0 dB |
| Bandwidth @-3.0 dB | |
| No. 1 | 186.0 MHz |

METHOD OF PRODUCTION OF AN ANTENNA PATTERN

CROSS REFERENCE TO RELATED APPLICATIONS

This patent application is a U.S. national stage filing under 35 U.S.C. §371 of International Application No. PCT/SE2007/000898 filed Oct. 12, 2007, which claims priority of European Application No. EP06021750.2 filed Oct. 17, 2006. The entire disclosures of the applications identified in this paragraph are incorporated herein by reference in their entirety.

FIELD OF INVENTION

The present invention relates generally to antennas, and particularly to a method of production of an antenna pattern.

BACKGROUND

The market for portable radio communication devices, such as mobile phones, PDA, portable computers and similar devices, is today very competitive, which puts tough economical demands on the manufacturers. Furthermore, antennas of such devices many times only have access to limited space of different shapes.

One way of making inexpensive antennas is to electrolytic build up antenna patterns, which however is limited in choice of 3D shape details for the antenna pattern. One way of making advanced 3D shape details of antenna patterns is to use ink jet printers, laser activation devices, or similar devices, which however tends to make the antennas expensive to manufacture.

SUMMARY OF THE INVENTION

An object of the present invention is to provide a method of production of antenna patterns that makes antennas less expensive to manufacture.

This object, among others, is according to the present invention attained by a method, an antenna pattern and a portable radio communication device, respectively, as defined by the appended claims.

At insight of that the cost for production of an antenna pattern created by use of an ink jet printer, laser activation device, or similar device is very much dependent on the purchase cost for the manufacturing device, such as a laser activation device. In this way a significant reduction of manufacturing costs for making an antenna pattern is achieved by reducing the cycle time of e.g. the laser activation device, which is obtained by not activating inner portions of the antenna pattern.

Further features and advantages of the present invention will be evident from the following description.

BRIEF DESCRIPTION OF THE DRAWINGS

The present invention will become more fully understood from the detailed description of embodiments given below and the accompanying figures, which are given by way of illustration only, and thus, are not limitative of the present invention, wherein.

DETAILED DESCRIPTION OF EMBODIMENTS

In the following description, for purpose of explanation and not limitation, specific details are set forth, such as particular techniques and applications in order to provide a thorough understanding of the present invention. However, it will be apparent for a person skilled in the art that the present invention may be practiced in other embodiments that depart from these specific details. In other instances, detailed description of well-known methods and apparatuses are omitted so as not to obscure the description of the present invention with unnecessary details.

Figure 1A:
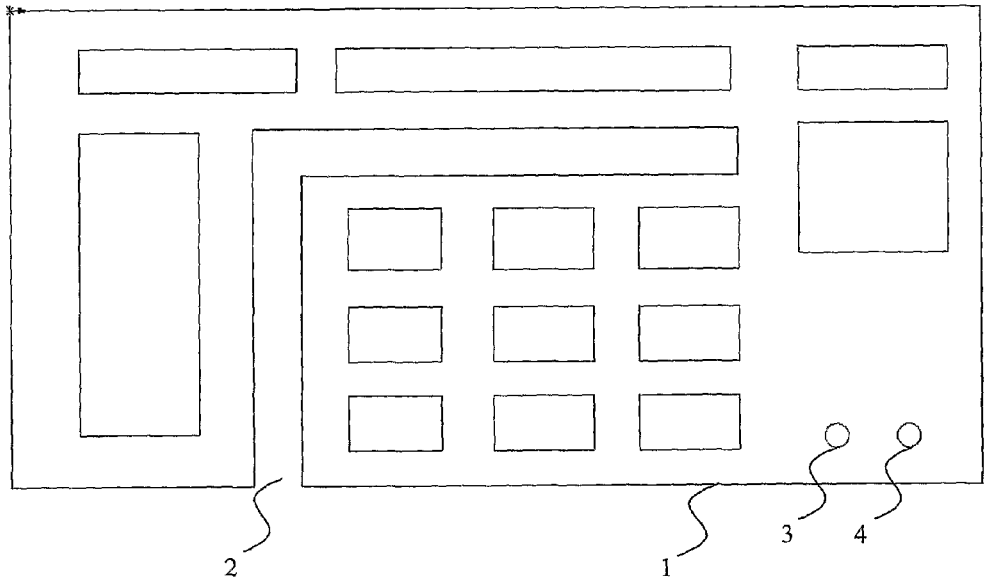
FIGS. 1*a-c* schematically shows antenna patterns produced according to the present invention.

A preferred embodiment of the present invention will now be described with reference to FIGS. 1*a-c*.

An antenna pattern for a portable radio communication device, such as a mobile phone, personal digital assistant, portable computer or similar device, is created by a laser activation device and a following metallization process. Alternatively, the antenna pattern is created by an ink jet printer or similar device. The creating device is preferably capable of manufacturing 3D shaped antennas also having via holes.

The antenna pattern is in this embodiment exemplified having a predetermined general outline 1, preferably a generally rectangular outline 1 with a preferred L-shaped slot 2. Further, the antenna pattern is preferably provided with one or more feed points 3 and/or one or more ground points 4. The inner part of the predetermined general outline of the antenna pattern is for a plurality of inner portions empty by not being created by the laser activation device, which reduces the cycle time of the laser activation device considerably, at the same time largely maintaining antenna performance.

The more of the antenna pattern that is empty, i.e. not activated by the laser activation device, the shorter cycle time is for the laser activation device. Further, the antenna performance is more affected by empty portions close to the feed point and ground point, whereby the antenna pattern preferably is more densely activated close to the feed point and ground point, respectively. Portions close to sharp corners and the edges are preferably also somewhat more solid than the rest of the antenna pattern (not illustrated) to improve the antenna performance.

Figure 1B:
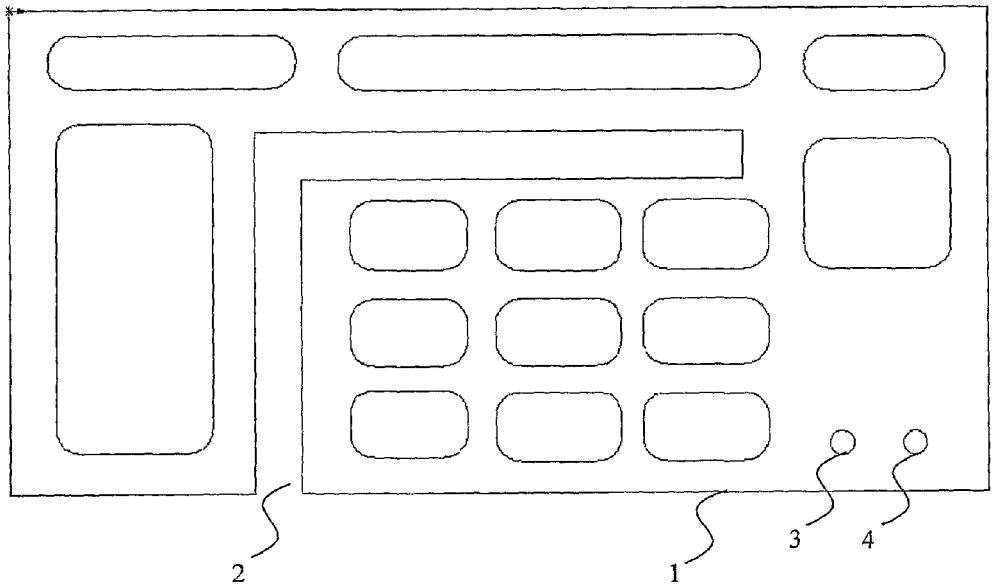
Figure 1C:
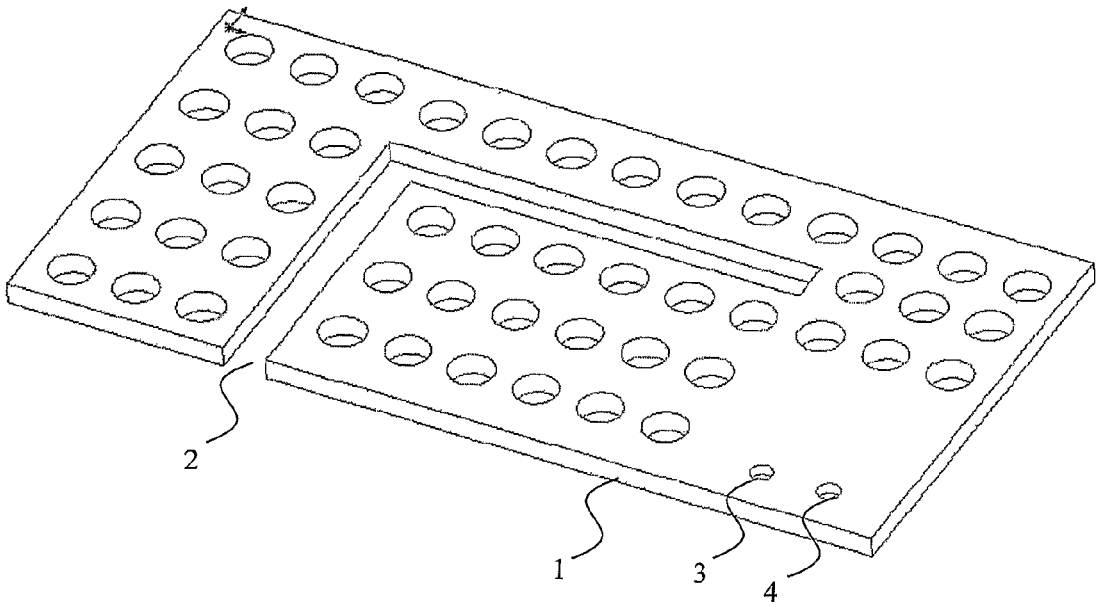

The plurality of empty inner portions of the antenna pattern not activated by the laser activation device is preferably rectangular-shaped having rounded corners, such as illustrated in FIG. 1*b*, which is advantageous for manufacturing and for antenna performance. Alternatively the plurality of empty inner portions are rectangular having sharp corners as illustrated in FIG. 1*a*, are circular as illustrated in FIG. 1*c* or having other shapes such as irregular shapes.

Advantageously, the empty spaces of the antenna pattern can be used to position discrete components therein, to save space in a portable radio communication device. Although the present invention is to its most advantage for antennas having large connected areas, wherein great reduction of cycle time can be achieved by the present invention, also other antennas having small tongues and other complex structures benefit from having empty spaces.

In short a laser activation device modifies an organic-metallic complex such that only the modified portions are metallized during a later metallization process.

Figure 2:
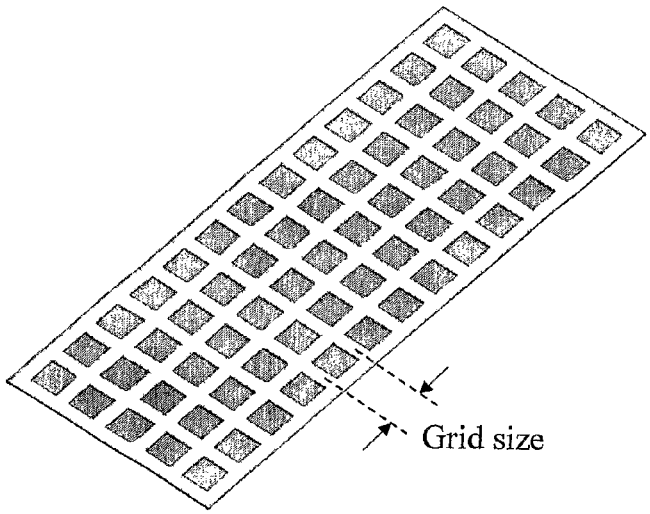
FIG. 2 schematically shows a grid pattern of an antenna having a generally rectangular outline.
Figure 3:
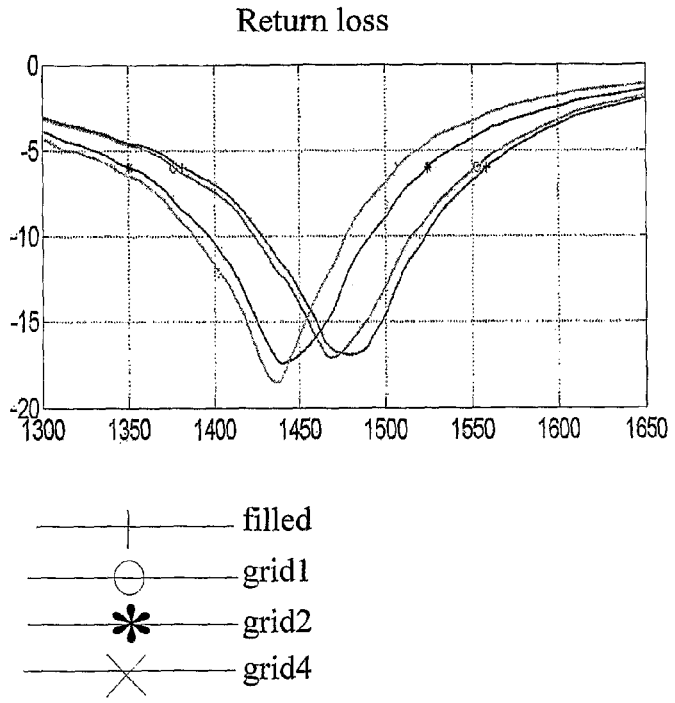
FIG. 3 is a return loss chart for different grid sizes of the antenna in FIG. 2.
Figure 4:
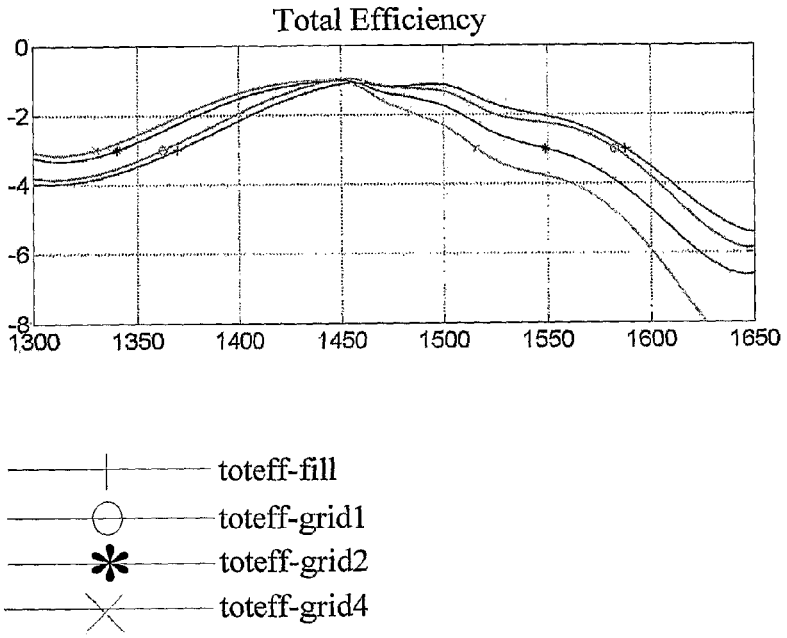
FIG. 4 is a total efficiency chart for different grid sizes of the antenna in FIG. 2.

Next is an experiment illustrating the antenna performance for different antennas patterns having different grid sized is shown in connection with FIGS. 2-4.

The return loss and total efficiency was measured for an antenna having a general outline of a rectangle. The measurement was performed for a solid antenna pattern, an antenna pattern having a grid size of 1 mm, a grid size of 2 mm and a grid size of 4 mm, respectively. The bandwidth at −6 dB was largely unaffected of the grid size, even if the centre frequency was somewhat shifted. Such a frequency shift is however easily compensated for by matching of the antenna. Also for the total efficiency of the antenna the bandwidth is largely unaffected.

It will be obvious that the present invention may be varied in a plurality of ways. Such variations are not to be regarded as departure from the scope of the present invention as defined by the appended claims. All such variations as would be obvious for a person skilled in the art are intended to be included within the scope of the present invention as defined by the appended claims.

The invention claimed is:

1. A method of production of an antenna pattern having a predetermined general outline, created with an ink jet printer, laser activation device or similar device, the method comprising creating said antenna pattern with a plurality of empty inner portions within said general outline, wherein said predetermined general outline is more densely printed or activated than inner portions of the antenna pattern.

2. The method according to claim 1, wherein said plurality of empty inner portions has rounded corners.

3. The method according to claim 1, wherein said plurality of empty inner portions are arranged in a grid.

4. The method according to claim 1, wherein said predetermined general outline is generally rectangular and is provided with a slot.

5. The method according to claim 1, wherein said antenna pattern is created with an ink jet printer or laser activation device.

6. The method according to claim 1, wherein said antenna pattern is created with a laser activation device.

7. A method of production of an antenna pattern having a predetermined general outline, created with an ink jet printer, laser activation device or similar device, the method comprising creating said antenna pattern with a plurality of empty inner portions within said general outline, wherein said antenna pattern comprises one or more feed points and wherein inner portions close thereto being more densely printed or activated than other inner portions of the antenna pattern.

8. The method according to claim 7, wherein said antenna pattern comprises one or more ground points and wherein inner portions close thereto being more densely printed or activated than other inner portions of the antenna pattern.

9. The method according to claim 7, wherein said predetermined general outline is more densely printed or activated than inner portions of the antenna pattern.

10. The method according to claim 7, wherein said predetermined general outline is generally rectangular and is provided with a slot; and/or wherein said plurality of empty inner portions are arranged in a grid.

11. A method of production of an antenna pattern having a predetermined general outline, created with an ink jet printer, laser activation device or similar device, the method comprising creating said antenna pattern with a plurality of empty inner portions within said general outline, wherein said antenna pattern comprises one or more ground points and wherein inner portions close thereto being more densely printed or activated than other inner portions of the antenna pattern.

12. The method according to claim 11, wherein said predetermined general outline is more densely printed or activated than inner portions of the antenna pattern.

13. The method according to claim 11, wherein said predetermined general outline is generally rectangular and is provided with a slot, and/or wherein said plurality of empty inner portions are arranged in a grid.

14. An antenna pattern having a predetermined general outline and a plurality of empty inner portions, wherein said antenna pattern is created by an ink jet printer, laser activation device or similar device, wherein said predetermined general outline is more densely printed or activated than inner portions of the antenna pattern.

15. The antenna pattern of claim 14, wherein said antenna pattern comprises one or more feed points and wherein inner portions close thereto being more densely printed or activated than other inner portions of the antenna pattern.

16. The antenna pattern of claim 14, wherein said antenna pattern comprises one or more ground points and wherein inner portions close thereto being more densely printed or activated than other inner portions of the antenna pattern.

17. The antenna pattern of claim 14, wherein said antenna pattern is created by a laser activation device; and/or wherein said plurality of empty inner portions are arranged in a grid.

18. A portable radio communication device comprising an antenna pattern having a predetermined general outline and a plurality of empty inner portions, wherein said antenna pattern is created by an ink jet printer, laser activation device or similar device, wherein said predetermined general outline is more densely printed or activated than inner portions of the antenna pattern.

19. The portable communication device according to claim 18, wherein said antenna pattern comprises one or more ground points and wherein inner portions close thereto being more densely printed or activated than other inner portions of the antenna pattern.

20. The portable radio communication device of claim 18, wherein said antenna pattern is created by a laser activation device; and/or wherein said plurality of empty inner portions are arranged in a grid.

* * * * *